United States Patent [19]

Cunningham

[11] 4,032,423

[45] June 28, 1977

[54] METHOD OF ASSEMBLING A BIPOLAR ELECTROLYZER

[75] Inventor: Hugh Cunningham, Corpus Christi, Tex.

[73] Assignee: PPG Industries, Inc., Pittsburgh, Pa.

[22] Filed: June 9, 1976

[21] Appl. No.: 694,505

[52] U.S. Cl. ..... 204/254; 204/98; 204/256; 204/283; 204/289

[51] Int. Cl.[2] ..... C25B 1/34; C25B 9/02; C25B 13/00; C25B 13/04

[58] Field of Search .... 204/98, 128, 252, 254–256, 204/258, 280, 289, 282, 283

[56] References Cited

UNITED STATES PATENTS

| | | | |
|---|---|---|---|
| 3,853,720 | 12/1974 | Korach et al. | 204/98 |
| 3,853,721 | 12/1974 | Darlington et al. | 204/98 |
| 3,910,827 | 10/1975 | Raetzsch et al. | 204/98 |
| 3,928,166 | 12/1975 | O'Leary et al. | 204/282 |
| 3,960,697 | 6/1976 | Kircher et al. | 204/252 |

FOREIGN PATENTS OR APPLICATIONS

| | | | |
|---|---|---|---|
| 1,410,313 | 10/1975 | United Kingdom | 204/282 |

*Primary Examiner*—Arthur C. Prescott
*Attorney, Agent, or Firm*—Richard M. Goldman

[57] ABSTRACT

Disclosed is a method of assembling a diaphragm cell having the electrodes of like polarity at a narrow pitch, and interleaved with electrodes of opposite polarity at a narrow interelectrode gap. The electrolytic cell is assembled while avoiding damage of the diaphragm during assembly. This is accomplished by drawing the diaphragm while maintaining a barrier between a pair of adjacent cathodes, avoiding bridging between adjacent cathode fingers. Additionally, where each anode is formed from a pair of metal sheets, the anode sheets are jointed together with leachable joint at the end of the sheets spaced from the anode unit.

11 Claims, 7 Drawing Figures

METHOD OF ASSEMBLING A BIPOLAR ELECTROLYZER

DESCRIPTION OF THE INVENTION

Electrolytic cells, e.g., electrolytic diaphragm cells for electrolysis of alkali metal chlorides such as sodium chloride or potassium chloride, have an anode unit and a cathode unit. The anode unit has a base, also called a backplate, and anodes extending therefrom.

The anodes are coated metal anodes. In one exemplification the anodes may be a pair of parallel plates spaced from each other and disposed between a pair of fingered cathodes. In an alternative design, the anodes may be single plates at a narrow pitch between a pair of adjacent cathode fingers also at a narrow pitch.

The cathode units have a backplate or baseplate with hollow cathode fingers extending outwardly therefrom. A backscreen is spaced from and parallel to the backplate. The interior of the cathode fingers and the volume between the backscreen and the backplate is the catholyte chamber.

When the cathode unit and anode unit are assembled with the anodes and cathodes interleaved between each other, an electrolytic cell is formed.

The total voltage drop through a bipolar electrolyzer contains a current-resistance component through the backplate from the cathodes of one cell to the anodes of the next adjacent cell, a current-resistance component through the internals of the anode, chlorine overvoltage and equilibrium chlorine evolution voltage components at the surface of the anode, an electrolyte current-resistance component across the electrolyte from the anode to the cathode, hydrogen evolution equilibrium voltage hydrogen evolution over-voltage components at the surface of the cathode, and a current-resistance component along the internal members of the cathode. One aspect of the total voltage drop which is particularly sensitive to design changes is the current-resistance voltage drop through the electrolyte. This component is dependent on the interelectrode gap, that is the distance measured from the electrode of one polarity to the facing electrode of opposite polarity.

It has now been found that the interelectrode gap may be reduced, e.g., to 10 millimeters or less, or even as narrow 5 millimeters. If particular care is taken in assembling the electrolyzer, as by depositing the diaphragm on the cathode fingers while maintaining an impermeable barrier between adjacent cathodes, in order to avoid bridging of asbestos between adjacent cathodes. It has further been found that a narrow interelectrode gap may be maintained if, in the case of anodes formed by a pair of coated metal sheets or plates, extending from a common backplate or baseplate, the sheets are joined together at the end thereof opposite the baseplate or backplate. This may be done with an acidified brine leachable joint. In this way, the anodes are closed together during assembly and assume their normal position during the actual operation. It has been found that when these methods are combined a cell having a narrow interelectrode gap may be assembled under industrial conditions.

DETAILED DESCRIPTION

Figure 1:
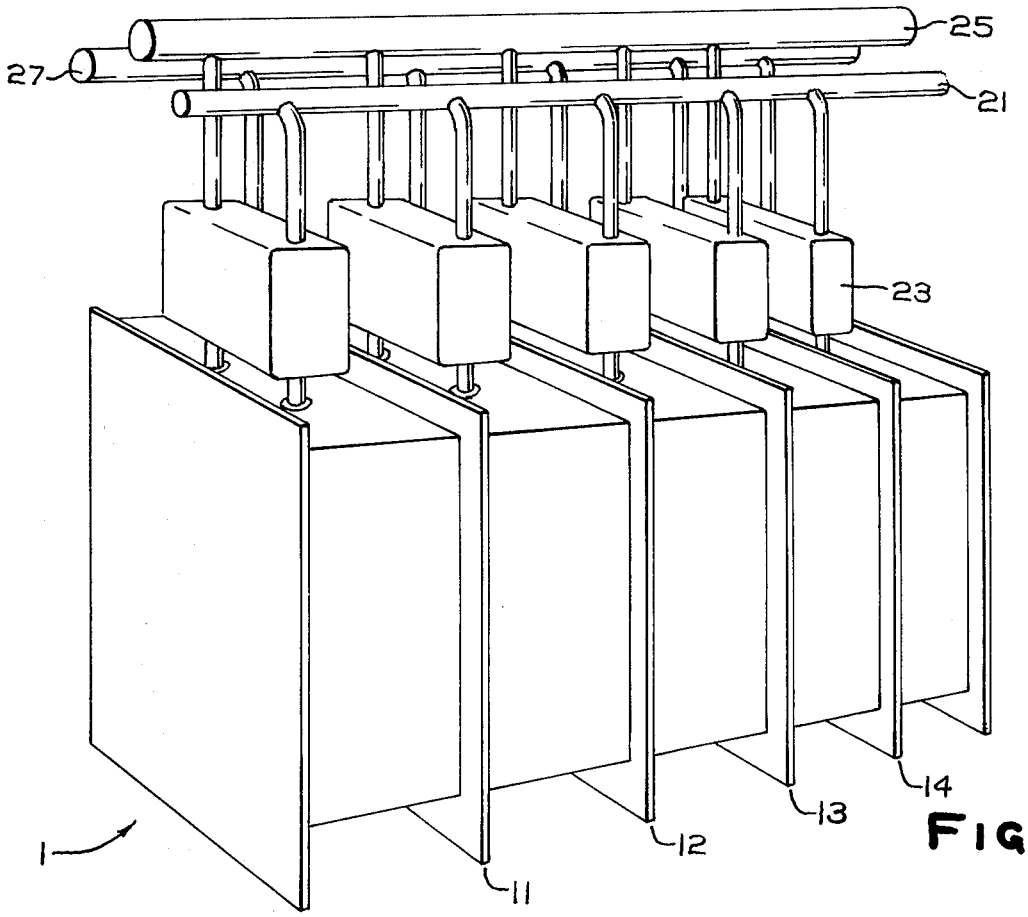
FIG. 1 is a general view of an electrolyzer.

A bipolar electrolyzer 1 is shown in FIG. 1. The bipolar electrolyzer 1 has a plurality of individual bipolar electrodes, i.e., bipolar units 11, 12, 13 and 14 with the anodic half of one bipolar unit and the cathodic half of the next adjacent bipolar unit forming a single electrolytic cell.

Reactant, i.e., sodium chloride brine, is fed to the electrolyzer 1 through a brine feed header 21 to a brine box 23, and form the brine box 23 to anolyte compartments of the individual cells. Anolyte product, i.e., chlorine gas is recovered from the individual cells in the brine box 23, and recovered from the brine box 23 to chlorine header 25. The gaseous catholyte product, i.e., hydrogen, is recovered from the catholyte compartments of the cells through hydrogen header 27. The liquid catholyte product, i.e., cell liquor, is recovered from the cell through a perc-pipe, not shown.

Figure 6:
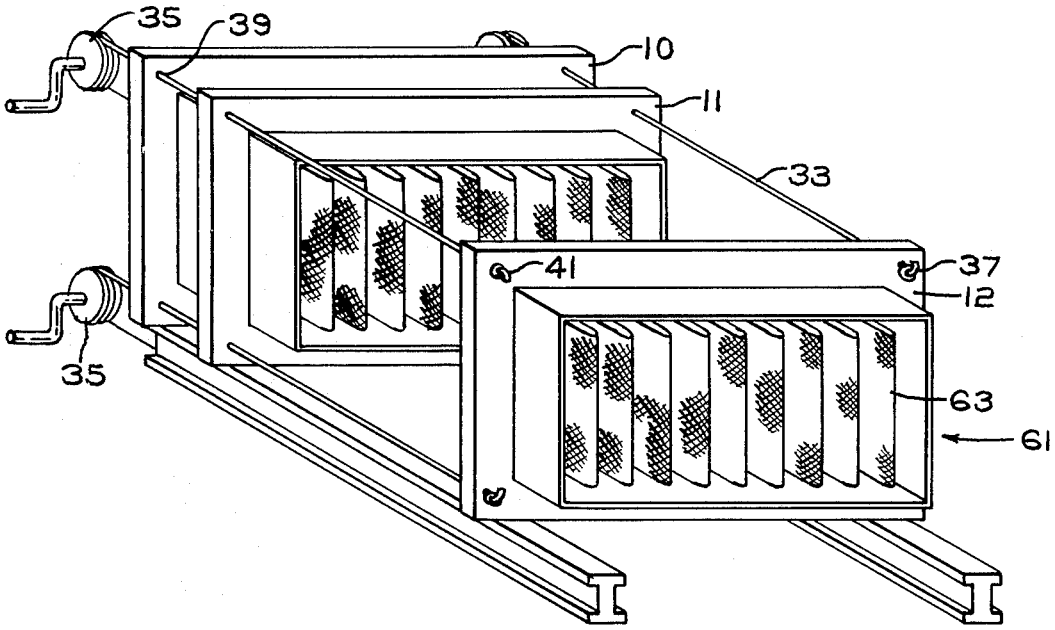
FIG. 6 shows a partially assembled electrolyzer on a base.

Bipolar electrolyzers 1 may be assembled by the method described in U.S. Pat. No. 3,755,108 to Raetzsch et al for "Method of Producing Uniform Anolyte Heads in the Individual Cells of Bipolar Electrolyzers" and shown in FIG. 6. As there described the individual bipolar units may be mounted on a base frame 31 with the anodic end unit 10 mounted first. The intermediate bipolar units are then mounted such that the anodes of one unit 11 are interleaved with the cathodes of the next adjacent bipolar unit 12 in the electrolyzer 1. Finally, the anodic end unit, not shown, is mounted on the base frame 31. Alternatively, the order of installing the bipolar units may be reversed with the cathodic end unit being mounted on the base frame first, followed by the intermediate bipolar units, and finally the anodic end unit.

In the method of assembly described above, an insulated metal line or an insulated wire 33 is run along each side of the electrolyzer from a winch take-up means 35, through each bipolar unit to a hook eye 37, which connects through a lug 39, with a wing nut or throttling nut 41 and a stay. Individual bipolar units 11, 12 may then be slowly winched together along the base frame 31. According to an alternative exemplification, each bipolar unit 11, 12 may be individually winched along the base frame 31.

The total assembly of individual units 10, 11, 12, 13, 14 comprising the electrolyzer 1 is held together by providing a compressive force on the two end half units 10. Specifically, a plurality of insulated tie rods may be used to apply a compressive force on the two end half units.

Each bipolar electrode, i.e., a bipolar unit 11, 12, 13, 14 includes an anodic unit 61 as one surface thereof and a cathodic unit 51 as the opposite surface thereof. Anodes 63 extend outwardly from the anodic surface of the backplate 17. The anodes 63 themselves are coated metal, e.g., titanium plate with a suitable electroconductive, electrocatalytic surface thereon. The anodes 63 may either be in the form of a pair of parallel or substantially parallel plates 65 between each pair of adjacent cathodes 53 or single plates 65 between each pair of adjacent cathodes 53. When the anodes 63 are in the form of single plates 65 between a pair of adjacent cathodes 53, the cathodes 53 are at a narrow pitch, i.e., at a close center to center spacing, thereby requiring special care in depositing the diaphragm.

The cathodic unit 51 of the bipolar unit includes the cathodic surface of the backplate 17. Typically, hollow cathode fingers 53 extend outwardly from the backplate 17. The cathodic unit 51 further includes a backscreen 55 which is parallel to the backplate 17 and spaced therefrom. The cathode fingers 53 and the backscreen 55 are formed of an electrolyte permeable material such as metal mesh, expanded metal mesh, perforated plates, perforated sheets or the like. Either a permeable diaphragm or an impermeable membrane is deposited on the backscreen 55 and cathode fingers 53.

When the diaphragm is a fibrous asbestos diaphragm, for example, a chrysotile asbestos diaphragm, the asbestos diaphragm is typically deposited by first forming a slurry containing about 1 to about 3 percent chrysotile asbestos in an aqueous liquid of about 10 to about 15 weight percent sodium chloride and about 5 to about 15 percent sodium hydroxide. This liquid composition is agitated, for example, by bubbling nitrogen or air through the liquid. The cathode unit 51 is then brought into contact with the slurry, for example, by lowering the cathode unit 51 a slurry tank 71 containing the slurry. Thereafter a vacuum is drawn within the cathode unit 51 thereby to draw the slurry through the cathode unit 51 and deposit asbestos on the cathode fingers 53 and cathodic backscreen 55.

While the slurry is referred to as being an asbestos slurry it may also be a slurry containing both asbestos and organic materials. The organic materials are typically polymers useful in imparting desirable properties to the diaphragm, e.g., controlling porosity, increasing strength, increasing life, etc. Useful polymers include hydrocarbons, fluorocarbons, chlorocarbons, and chlorofluorcarbons such as polyethylene, polyvinylchloride, polyvinylidenechloride, polyvinylfluoride, polyvinylidenefluoride, polyfluorotrichloroethylene, polytetrafluoroethylene, and the like.

After deposition of the diaphragm, the cathode assembly 51 is removed from the slurry tank 71. The cathode unit 51 may be further treated, for example, by heating, drying, or depositing other materials on the surface of the deposited asbestos. Thereafter, the anodic side 61 of one bipolar unit and the cathodic side 51 of the next adjacent bipolar unit are assembled to form an individual cell of a bipolar electrolyzer 1, as described hereinabove. When the anodic unit 61 and cathodic unit 51 are assembled with the anodes 63 and cathodes 53 interleaved between each other, an electrolytic cell is formed.

According to the method of this invention, at small electrode pitches, that is, at small center line to center line distances between electrodes or like polarity, bridging of the fibrous material, as asbestos, during the deposition thereof may be prevented. This is accomplished by providing a barrier 83 between a pair of adjacent cathodes 53 during diaphragm deposition. This may be accomplished according to one exemplification of this invention by blanking of alternative cathode fingers 53 during diaphragm deposition, e.g., by placing a cap, boot, or cover over alternate cathodes 53.

Figure 2:
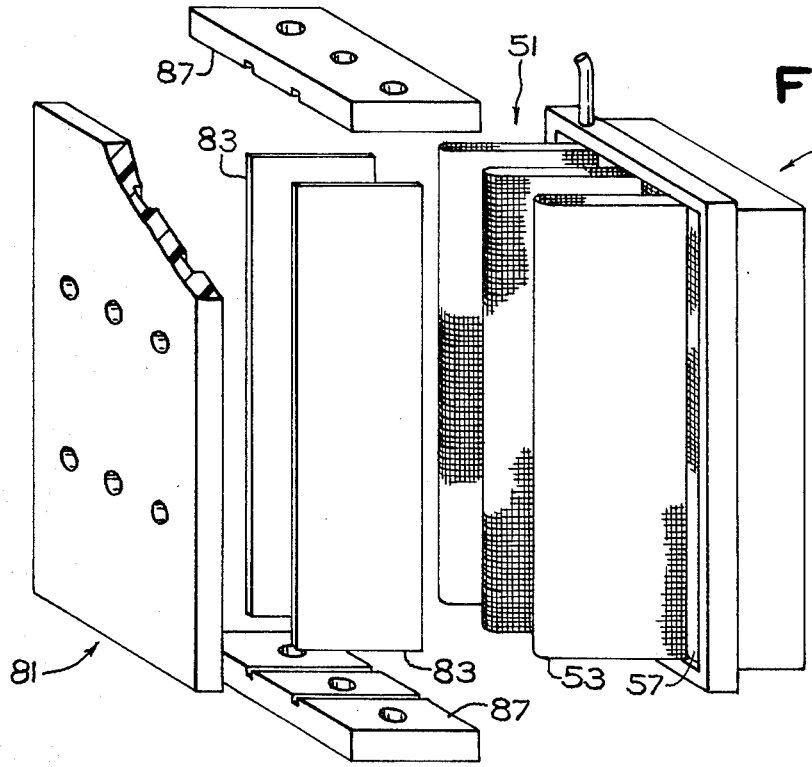
FIG. 2 is an exploded view of die for use with a cathode unit during diaphragm deposition.
Figure 3:
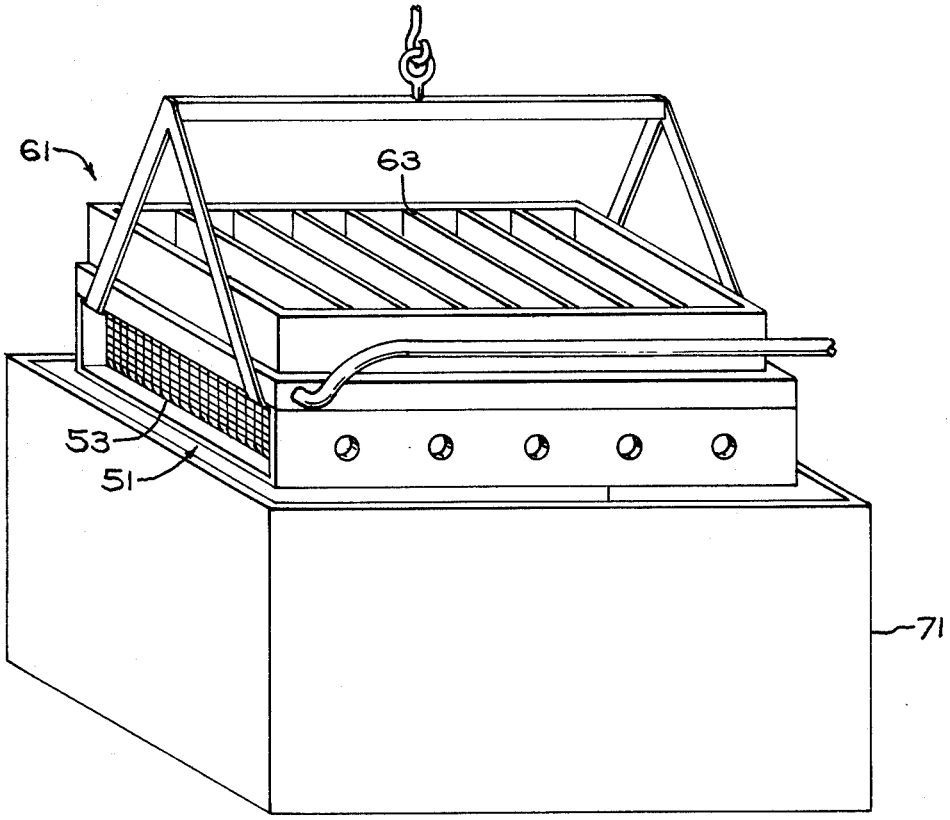
FIG. 3 shows the lowering of a bipolar unit into a slurry tank.

Alternatively, as shown in FIGS. 2 and 3, a liquid impermeable barrier 83 may be interposed between a pair of adjacent cathodes 53. This may be accomplished by the use of a die 81 or template, as shown in FIG. 2, having liquid impermeable barriers 83 extending from the top 88 to the bottom 87 thereof and having perforations of openings in the top, end, and bottom to allow for the free passage of the slurry to the cathodes. The cathodic unit, with the template providing a hydraulic barrier between adjacent cathodic fingers is then brought into contact with the slurry, e.g., in slurry tank.

According to a further exemplification of the embodiment where a barrier is interposed between adjacent cathode fingers 53, an initial partial deposit of the diaphragm material is made on the cathode fingers 53. Thereafter the barriers are inserted between the cathode fingers 53, e.g., as a comb to break up the diaphragm material bridges formed during the initial rush of fibers onto the bare cathode fingers 53. Thereafter diaphragm deposition may be resumed either with or without the barrier interposed between the cathode fingers 53.

Figure 5:
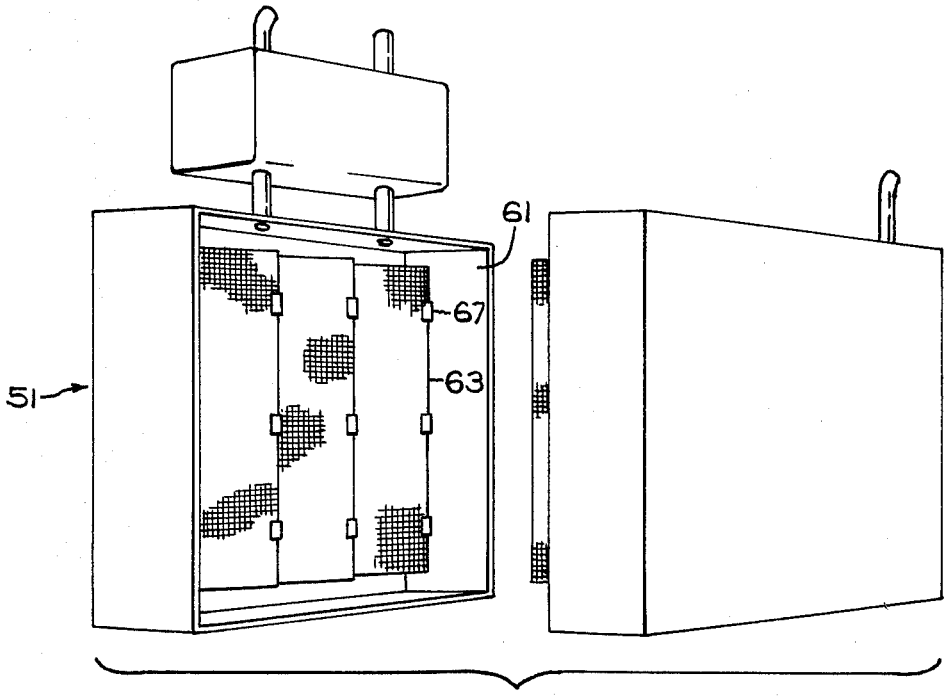
FIG. 5 is an exploded view of a single cell formed by two bipolar units.
Figure 4:
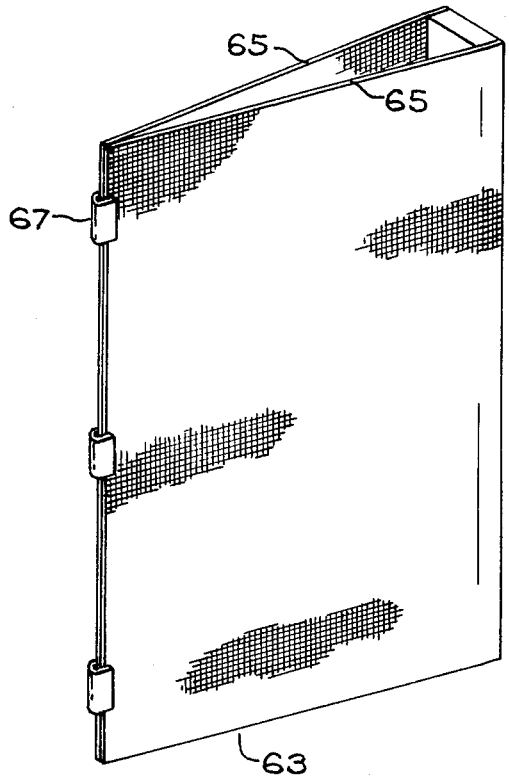
FIG. 4 shows an anode with anode clips.
Figure 7:
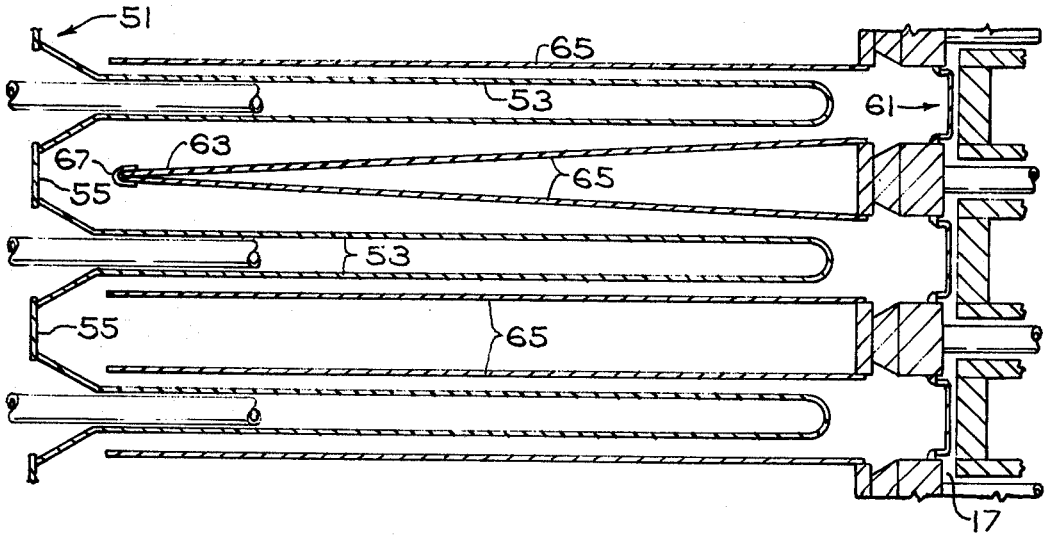
FIG. 7 is a plan view of an electrolytic cell.

To obtain additional space between electrodes of opposite polarity during assembly, while avoiding damage to the diaphragm of membrane, the anode sheets 65 may be joined together with an acidified sodium chloride brine leachable joint 67 at the end space of the anode unit. This is shown with particularity in FIGS. 4 and 5. By an "acidified brine leachable" material is meant a material that loses its holding or is reduced in tensile strength at the cell electrolyte temperatures, i.e., above about 85° C., and in the acidified brine electrolyte, i.e., sodium chloride brine at a pH of 3.5 to 4.5. The joint 67 may be a clip, spring, spacer, glue, cement, or the like. Typical acidified sodium chloride brine permeable or leachable materials include wax, brass, asbestos string, cotton string an household glue.

Additionally, an insulated spacer rod, not shown, may be used between the anode fingers C 3 and the cathode fingers 53 so that the anode may spring freely after breaking the hold of the leachable joint C 7. In this way direct shorts are eliminated. Furthermore, this spacer rod allows the flexible anode 63 to parallel the shape of the more rigid cathode 53, resulting in a uniform interelectrode and a uniform current density distribution.

While the exemplification has been described with reference to the combination of both embodiments thereof, it is to be understood that any one of the embodiments may be used separately, that is the permeable barrier between adjacent cathodes 53 during diaphragm deposition may be used alone. The acidified brine leachable joint 67 may also be used alone. Preferably, however, both are used jointly.

While the invention has been described with reference to specific embodiments and exemplifications thereof, the invention is not to be so limited except as in the claims appended hereto.

I claim:

1. In a method of assembling a diaphragm cell having a cathode unit containing a plurality of fingered cathodes, and an anode unit containing a plurality of metal extending outwardly from the anode unit, said method comprising the steps of bringing the cathode unit into contact with a slurry, depositing a diaphragm from the slurry onto the fingered cathodes, removing the cathode unit from the slurry, and assembling the anode unit and the cathode unit whereby to form an electrolytic cell having the anodes thereof interleaves between the cathodes thereof, the improvement comprising:

providing a barrier between a pair of cathodes during diaphragm deposition on said cathodes; and assembling the anode and cathode units to form a diaphragm cell.

2. The method of claim 1 comprising placing an electrolyte permeable template having electrolyte impermeable barriers corresponding to and offset from said cathodes around said cathode unit and thereafter depositing the diaphragm onto the cathodes.

3. The method of claim 1 comprising partially depositing the diaphragm, and thereafter placing the barrier between adjacent cathode fingers.

4. The method of claim 1 comprising placing covers over alternate cathode fingers.

5. The method of claim 1 wherein each said anodes are formed of a pair of metal sheets, and wherein said metal sheets are joined together with an acidified sodium chloride brine leachable joint at the end spaced from the anode unit.

6. In a method of assembling a diaphragm cell having a cathode unit containing a plurality of fingered cathodes, and an anode unit containing a plurality of metal anodes extending outwardly from the anode unit, each of said anodes being formed of a pair of metal sheets, said method comprising the steps of bringing the cathode unit into contact with a slurry, depositing a diaphragm from the slurry onto the fingered cathodes, removing the cathode unit from the slurry, and assembling the anode unit and the cathode unit whereby to form an electrolytic cell having the anodes thereof interleaved between the cathodes thereof, the improvement comprising:

joining the anode sheets together with an acidified sodium chloride brine leachable joint at the end spaced from the anode unit; and assembling the anode and cathode units to form a diaphragm cell.

7. The method of claim 6 comprising providing a barrier between a pair of cathodes during diaphragm deposition on said cathodes.

8. The method of claim 7 comprising an electrolyte permeable template having electrolyte impermeable barriers corresponding to and offset from said cathodes and said cathode unit and thereafter depositing the diaphragm onto the cathodes.

9. The method of claim 7 comprising partially depositing the diaphragm and thereafter placing the barrier between adjacent cathode fingers.

10. The method of claim 7 comprising placing covers over alternate cathode fingers.

11. In a method of assembling a diaphragm cell having a cathode unit containing a plurality of fingered cathodes, and an anode unit containing a plurality of metal anodes extending outwardly from the anode unit, each of said anodes being formed of a pair of metal sheets, said method comprising the steps of bringing the cathode unit into contact with a slurry, depositing a diaphragm from the slurry onto the fingered cathodes, removing the cathode unit from slurry, and assembling the anode unit and the cathode unit whereby to form an electrolytic cell having the anodes thereof interleaved between the cathodes thereof, the improvement comprising:

providing a barrier between a pair of cathodes during diaphragm deposition on said cathodes;

joining the anode sheets together with an acidified sodium chlorine brine leachable joint at the end spaced from the anode unit; and assembling the anode and cathode units to form a diaphragm cell.

* * * * *

UNITED STATES PATENT AND TRADEMARK OFFICE

CERTIFICATE OF CORRECTION

PATENT NO. : 4,032,423

DATED : June 28, 1977

INVENTOR(S) : Hugh Cunningham

It is certified that error appears in the above-identified patent and that said Letters Patent are hereby corrected as shown below:

Column 4, line 63, --anodes-- should be inserted after "metal".

Column 5, line 2, "interleaves" should be --interleaved--.

Column 6, line 9, --placing-- should be inserted after "comprising".

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*